United States Patent [19]

Klawitter

[11] Patent Number: 4,896,879

[45] Date of Patent: Jan. 30, 1990

[54] ADJUSTABLE WEIGHT DEVICE FOR HUMAN JOINT OR MUSCLE EXERCISE

[76] Inventor: Ronald J. Klawitter, 321 Fifth St., West, Hector, Minn. 55342

[21] Appl. No.: 212,564

[22] Filed: Jun. 28, 1988

[51] Int. Cl.[4] ..... A63B 21/12

[52] U.S. Cl. ..... 272/119; 272/DIG. 4; 272/96

[58] Field of Search ..... 272/96, 130, 119, 143, 272/145, 122; 128/25.3

[56] References Cited

U.S. PATENT DOCUMENTS

| | | | |
|---|---|---|---|
| D. 271,408 | 11/1983 | Bauer | D21/197 |
| 2,114,790 | 4/1938 | Venables | 272/57 |
| 2,214,052 | 9/1940 | Good | 272/57 |
| 2,689,127 | 9/1954 | Silverton et al. | 272/145 X |
| 2,849,237 | 8/1958 | Simithis | 272/119 |
| 3,231,270 | 1/1966 | Winer | 272/84 |
| 3,380,447 | 4/1968 | Martin | 272/145 X |
| 3,406,968 | 10/1968 | Mason | 272/119 |
| 4,079,932 | 3/1978 | Schuetz | 272/122 X |
| 4,357,009 | 11/1982 | Baker | 272/96 |
| 4,575,074 | 3/1986 | Damratoski | 272/119 |
| 4,602,784 | 7/1986 | Budden et al. | 272/119 |
| 4,621,808 | 11/1986 | Orchard et al. | 272/119 |
| 4,650,183 | 3/1987 | McIntyre | 128/25 B X |

*Primary Examiner*—Richard J. Apley
*Assistant Examiner*—H. Flaxman
*Attorney, Agent, or Firm*—Kinney & Lange

[57] ABSTRACT

An adjustable boot-shaped weight for exercising a human joint or muscle group, such as a knee, by strapping onto the foot and filling the container with liquid or other flowable material in the hollow body of the device. The ball of the foot extends beyond the base of the container, and the concave leg support partially surrounds the back portion of the leg while extending above the ankle to prevent slipping. The retainers over the instep and the lower leg keep the leg in place while the lining provides comfort for the user.

5 Claims, 2 Drawing Sheets

ADJUSTABLE WEIGHT DEVICE FOR HUMAN JOINT OR MUSCLE EXERCISE

BACKGROUND OF THE INVENTION

1. Field of the Invention.

This invention concerns a variable weight device for human joint or muscle exercise.

2. Description of the Prior Art.

Various adjustable weight devices have been disclosed in the prior art, which were designed to increase muscular effort while exercising. Added weight while exercising is considered beneficial to muscular development and joint rehabilitation. The use of weights enhances muscular development and speeds the rehabilitation process by strengthening joints. The preferred amount of weight varies with the exercise performed and the injury to be rehabilitated. The quadriceps and hamstring muscles may need redevelopment after surgery or when recovering from an injury.

U.S. Pat. No. 4,357,009 shows a liquid filled exercise weight bag having two compartments, one on the lower leg and the other on the foot, with a lace for keeping the bag in place. However, this adjustable weight surrounds only the front surface of the leg and the top surface of the foot, and is not rigid, which could lead to slipping or uncomfortable pressure on the top of the foot or ankle.

Another type of apparatus for leg exercise is advanced in U.S. Pat. No. 2,114,790, which reveals a boot-shaped foot supporting platform with a means for locking the handle of a dumbbell into the space between the heel and sole of the equipment. The same general type of weight boot is disclosed in U.S. Pat. No. 2,214,052 with the changeable load resting on top of the foot. Neither of these inventions for adjustable-weight boots supports the lower leg above the ankle. Keeping the foot and lower leg braced helps prevent slipping and provides more comfort for the user while exercising. Bracing the foot and leg may be necessary with certain leg injuries. Adjusting the weight of the device by changing dumbbells is clumsy and inconvenient. A separate set of specially fitted weights must be used to vary the weight of the boot.

Damratoski U.S. Pat. No. 4,757,074 explains the disadvantages of dumbbells for changing the weight of an exercise device and consequently discloses a hollow body disposed around a hand grip which can be filled with different substances of varying weight. This design would not support an ankle or hold the foot in a fixed position, making it unsuitable for rehabilitory exercises. The Damratoski invention is so small that it may not be large enough to weigh enough for large or very physically fit users, and consequently is ineffective.

U.S. Pat. Nos. 4,602,784 and 4,621,808 both present cuff-shaped adjustable weights for the ankle or wrist to be used while exercising. The earlier Budden Pat., No. 4,602,784, reveals a cuff of torodial shape, with the tubular member charged with lead shot. The elastic fabric comprising the exterior wall of the Budden invention can be stretched around the hand or foot to be worn around the wrist or ankle. Orchard Pat. No. 4,621,808 resembles the Budden Patent in its cuffed shaped and elastic nature. This second invention for a wrist or ankle band is to be filled with a particulate weight-adding agent. Both 4,602,784 and 4,621,808 require special fillers which are not easily obtained. Neither the Budden nor the Orchard devices would support the foot or ankle area with rigid surfaces under the foot or behind the leg. In light of the fact that each of these weight-cuffs is essentially flexible and elastic, durability could be a potential problem.

None of the previously known devices present an adjustable weight apparatus which is comfortable and has a substantially rigid surface for support and for ease of use, where the weight is readily changeable.

SUMMARY OF THE INVENTION

An adjustable weight device for exercising a human leg joint or muscle group, such as a knee, comprises a container having at least one material holding compartment in the hollow body of the device. A first surface of the container is adapted to engage the bottom of the foot of a user, and a second surface extends upwardly at substantially right angles to the first surface. The surfaces support the leg and foot and hold them while exercising. The ball of the foot extends beyond the base of the container and the first surface so the toes are not constrained. The leg support is concave and partially surrounds the back portion of the leg. Preferably, the container is a hollow, molded hard plastic body which, as shown, has a single top opening with a threaded neck that could be closed by a screw-on cap, or a friction-cap type closing.

The foot is positioned on the device and retainers are provided for strapping the foot firmly onto the user to prevent slipping. The retainers placed over the instep and the lower leg keep the weight in place. A lining is provided for comfort of the user, if desired. The use of retainers in two places prevents the apparatus from slipping around and being uncomfortable. The retainers can be straps employing Velcro hook and loop fasteners or with plastic snap-type buckles on a adjustable length band, attached by cap screws to the device. Plastic gripping straps could be molded as part of the container.

The container can be filled with water, for example, or with dry particulate material such as sand, salt or gravel, or other liquids, to increase the weight. A typical size would weigh up to in the range of 19 pounds when filled. Varying the amount of liquid would provide a range of loads to be carried by the user capable of being changed to reflect the wearer's needs. The preferred amount of weight will vary with the physical condition of the individual and with the particular exercise being performed.

An exercise for strengthening muscle groups in the leg could be lifting the foot with the device outwardly and upwardly while sitting with the leg swinging freely from the knee. Another exercise could be done while sitting with the lower leg swinging freely and lifting from the thigh muscle, keeping the lower leg substantially at right angles to the floor plane to exercise the muscle groups in the upper leg and hip joint.

DETAILED DESCRIPTION OF THE PREFERRED EMBODIMENTS

Figure 1:
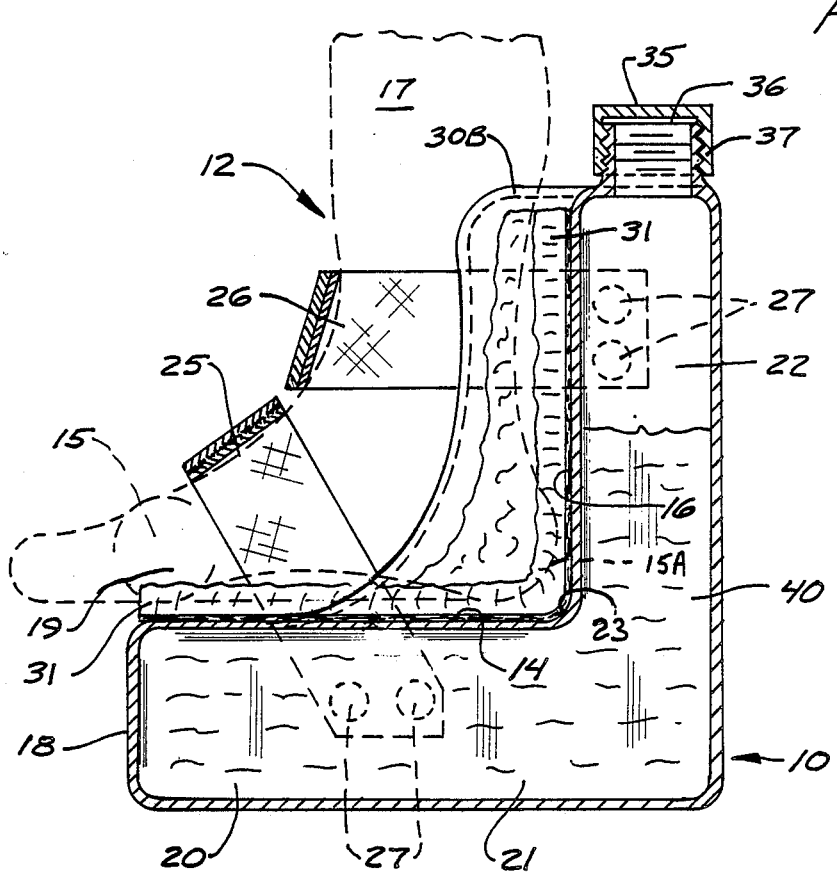
FIG. 1 is a vertical sectional view of an adjustable weight device for human joint or muscle group exercise shown engaged on the foot of a user.

Referring to the drawings, in FIG. 1, an adjustable weight device for exercising human joints or muscle groups is indicated generally at 10, and is supported on a foot and lower leg region shown generally at 12. The weight device comprises a first surface 14 substantially perpendicular to a second surface 16 which extends upwardly from the first surface 14. Surface 14 supports the foot 15 and is designed to engage the foot no farther then the ball 19 of the foot 15. The surface area 16 which extends upwardly from the surface 14 supports the lower leg 17. The device 10 comprises a hollow, molded plastic container 18 which has at least one compartment 20 defined therein. The container is preferably constructed from a rigid or semirigid, molded plastic. The compartment 20 has a first section 21 and a second section 22 defined on the interior of the device 10.

Figure 2:
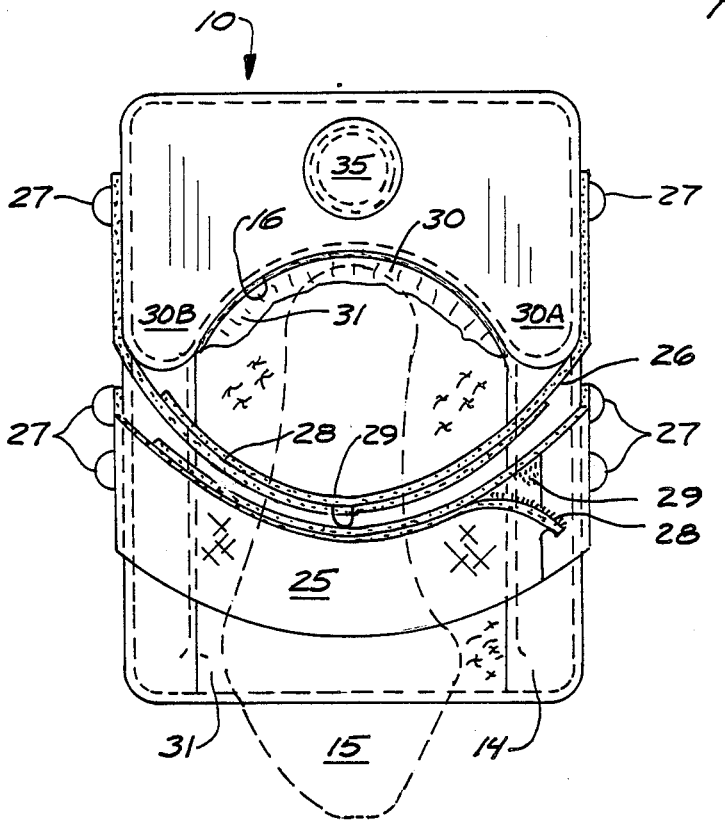
FIG. 2 is a top plan view of the device of FIG. 1.

As shown in FIG. 2, a concave shape 30 of upward surface 16 is formed to provide wall portions 30A and 30B which partially surround the back portion of the leg of the user. A heel 15A of the user seats back at junction region 23 of first and second surfaces 14 and 16, shown best in FIG. 1.

First fastening means 25, comprising strap sections 25A and 25B, fits over the instep of the foot 15. Second fastening means 26 comprises strap sections 26A and 26B that fit around the forward portion of the lower leg 17. The fasteners secure the general leg region 12 and foot 15 against the surfaces 14 and 16 and prevent slippage.

Figure 3:
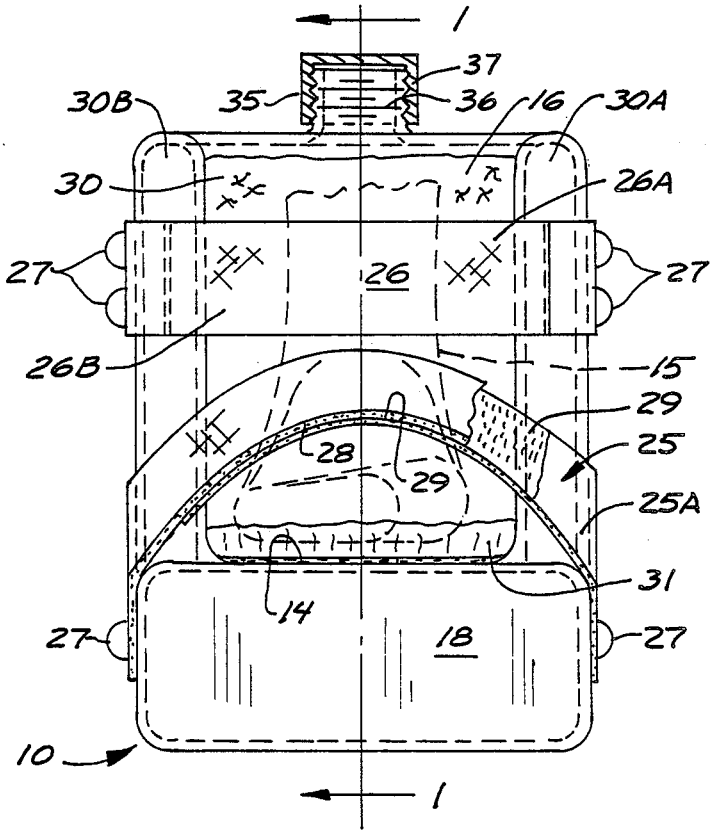
FIG. 3 is a front elevational view of FIG. 1.

The fastening means 25 and 26 comprise adjustable straps having ends of the respective strap sections fixed on the container side walls with cap screws 27 or other suitable fasteners. The ends of fastener sections 25A, 25B and 26A, 26B are held together by means such as hook and loop fastener (VELCRO) straps 28, 29 or snap type buckles so that the straps can be fitted as desired or required, as shown in FIG. 3. The fixed ends of the strap sections 25A, 25B, and 26A, 26B can be attached to the container 18 with adhesives or other fasteners.

A cushioning liner 31 is supported on the first and second surfaces 14, 16 between the foot area 15 and the lower leg 17 of the user and the container 10. This liner is preferably an absorbent pad that provides comfort or reduces slippage of the foot, for example, sheepskin or other absorbent and soft materials. Foam of various types could be used, and no pad has to be used. The foot can rest on the plastic surface 14.

A single access opening 35 with a threaded neck 36 is closed by a cap 37 as best shown in FIG. 3. The cap could also be a type of friction cap that would allow easy access, and would be attached to the device by a loop to prevent losing the cap while adjusting the weight by pouring liquid in or out.

The walls of the container preferably are not flexible, but retain a distinct shape so the container keeps the weight from shifting excessively. While some liquid flow back and forth will occur in the container, the secure support from the fastening means and the use of the liner 31 will prevent slipping between the foot and the container.

The shortened length of surface 14 permits toe movement and also fits a wide foot size range. The outer shape can be varied as desired, of course, but the support of the foot and leg is important.

The device is easily portable, easily made, and easily used, as well as being reliable because of its simple construction and readily available weight adjustment. Water can be filled in from a tap to add weight and the compartment 20 can be filled with granular solid materials, if desired. Sand, salt, gravel, lead or steel shot can be used, if desired. The filling is shown at 40. This adjustable weight device for human joint or muscle group exercise is designed for convenient installation and removal from the body.

Although the present invention has been described with reference to the preferred embodiments, workers skilled in the art will recognize that changes may be made in form and detail without departing from the spirit and scope of the invention. Normal knee therapy wuld be to lift wieghts, beginning at approximately 3 lbs., and continuing gradually upwards to 20 lbs.

What is claimed is:

1. A foot and lower leg mounted exercise device for exercising a human knee under external weight comprising:

a substantially rigid L-shaped container having a base section and an upright section joined together and at least one compartment defined on the interior thereof, and an access opening to the compartment at an upper portion of the upright section;

foot and lower leg support surface means formed on such container defining a first surface on an upper side of the base section and adapted to engage the bottom of the foot of a user and support such foot along the instep region, and a second surface joining the first surface and formed on the upright section extending upwardly and substantially at right angles to the first surface to be adjacent and in contact with the calf of the leg of a user when a foot of a user is supported on the first surface, the compartment including a first compartment portion below the first surface and a second compartment portion to the rear of the second surface, the second compartment portion extending upwardly along substantially the entire upright section;

a first adjustable strap fastener mounted on the first section and adapted to be positioned over an instep of a user above the first surface; and a second adjustable strap fastener mounted on the upright section and positioned for engaging and encircling a lower leg of a user and extending outwardly from the second surface, whereby the container can be filled with a variable amount of liquid including the compartment portion extending upwardly along the upright section of the container for adjusting the total weight carried for exercise, and wherein the ankle of a user is retained in substantially one position for such exercise when the container is in place on a user with the fastener means fastened to support such foot and lower leg.

2. A foot mounted variable weight exerciser comprising a substantially rigid L-shaped container having a base section and an upright section rigidly molded together and defining a liquid tight compartment on the interior thereof, the compartment including compartment portions substantially coextensive with both the base and upright sections, and an opening to the compartment for filling liquid into the compartment and removing liquid from the compartment;

foot and lower leg support surfaces formed on the respective base and upright sections of such container, including a first surface on an upper side of the base section and adapted to be engaged by the botton of a foot of a user and support such foot, the container having sufficient rigidity to support the weight of a user, and an upright surface joining the first surface and formed on the upright section and extending upwardly and substantially at right angles to the first surface to engage the calf of the leg of a user above the ankle and to the rear when a foot of a user is supported on the first surface, the container having lower and rear walls joined together and spaced from the first and second surfaces, respectively, to define the compartment with a first compartment portion extending under the first surface and a second compartment portion being positioned to the rear of the upright surface along substantially the entire upright length of the upright section of the container, the compartment being of sufficient size to hold a quantity of water for providing significant loads on leg joints of an adult user; and fastening means mounted on the container and adapted to be positioned over an instep of a foot of a user and for engaging a lower leg of a user to retain the container on such foot and lower leg of user, whereby the container can be filled with a variable amount of liquid for adjusting the total weight carried for exercise, and wherein such foot and lower leg of a user are supported on the respective base and upper section so the ankle of a user is retained in substantially one position for such exercise.

3. The apparatus as specified in claim 1 wherein said second surface is a concave surface partially surrounding the back portion of the leg of a user.

4. The apparatus as specified in claim 2 wherein said fastening means comprise adjustable straps on said container adapted to fit over the instep of user and around the forward portion of the leg of a user to retain the foot and leg of a user securely against the first and second surfaces.

5. The apparatus as specified in claim 2 and a cushioning liner positioned on the first and second surfaces, for positioning between the foot and lower leg of the user and the container.

* * * * *

UNITED STATES PATENT AND TRADEMARK OFFICE

CERTIFICATE OF CORRECTION

PATENT NO. : 4,896,879

DATED : January 30, 1990

INVENTOR(S) : Ronald J. Klawitter

It is certified that error appears in the above-identified patent and that said Letters Patent is hereby corrected as shown below:

Column 5, line 19, before "user" insert --a--.

Signed and Sealed this

Fourth Day of December, 1990

*Attest:*

HARRY F. MANBECK, JR.

*Attesting Officer*

*Commissioner of Patents and Trademarks*